United States Patent [19]

Olin et al.

[11] 4,297,751

[45] Nov. 3, 1981

[54] SEWER SYSTEM

[75] Inventors: Henry Olin, Espoo; Nils Tallberg, Helsinki; Martti Varis, Espoo, all of Finland

[73] Assignee: Oy Wartsila AB, Helsinki, Finland

[21] Appl. No.: 67,299

[22] Filed: Aug. 17, 1979

[30] Foreign Application Priority Data

Aug. 25, 1978 [FI] Finland ..... 782603

[51] Int. Cl.[3] ..... E03D 11/00

[52] U.S. Cl. ..... 4/431; 4/434; 4/316; 4/435; 4/415; 137/205

[58] Field of Search ..... 4/431, 421, 434, 435, 4/415, 439, 316; 137/205, 236 R

[56] References Cited

U.S. PATENT DOCUMENTS

| | | | |
|---|---|---|---|
| 3,239,849 | 3/1966 | Liljendahl | 4/431 |
| 3,302,216 | 2/1967 | Fulton | 4/434 |
| 3,482,267 | 12/1969 | Liljendahl | 4/431 |
| 3,686,693 | 8/1972 | Liljendahl | 137/205 |
| 3,746,032 | 7/1973 | Wallgren | 137/205 |
| 3,780,757 | 12/1973 | Jordan | 137/205 |
| 4,131,959 | 1/1979 | Albartassi | 4/431 |
| 4,164,049 | 8/1979 | Michael | 4/431 |
| 4,209,034 | 6/1980 | Michael | 4/431 X |

FOREIGN PATENT DOCUMENTS

| | | | |
|---|---|---|---|
| 2902476 | 7/1979 | Fed. Rep. of Germany | 4/431 |
| 2842322 | 12/1979 | Fed. Rep. of Germany | 4/431 |
| 2308742 | 4/1976 | France | 4/431 |

*Primary Examiner*—Henry K. Artis

*Attorney, Agent, or Firm*—McAulay, Fields, Fisher, Goldstein & Nissen

[57] ABSTRACT

A sewer system in which partial vacuum is used for transporting sewage through a sewer pipe to a collecting chamber or the like. The system comprises only a few sewage producing units, preferably only one at a time usable unit. The length of the sewer pipe from a sewage producing unit to the collecting chamber is comparatively small and the operating devices of the system are arranged to generate vacuum in the sewer pipe principally only for the time required for transporting each separate sewage discharge emitted into the sewer pipe. Preferably, the operating devices are arranged to stop generating the vacuum before the actual transport of the sewage takes part.

15 Claims, 2 Drawing Figures

SEWER SYSTEM

Figure 1:
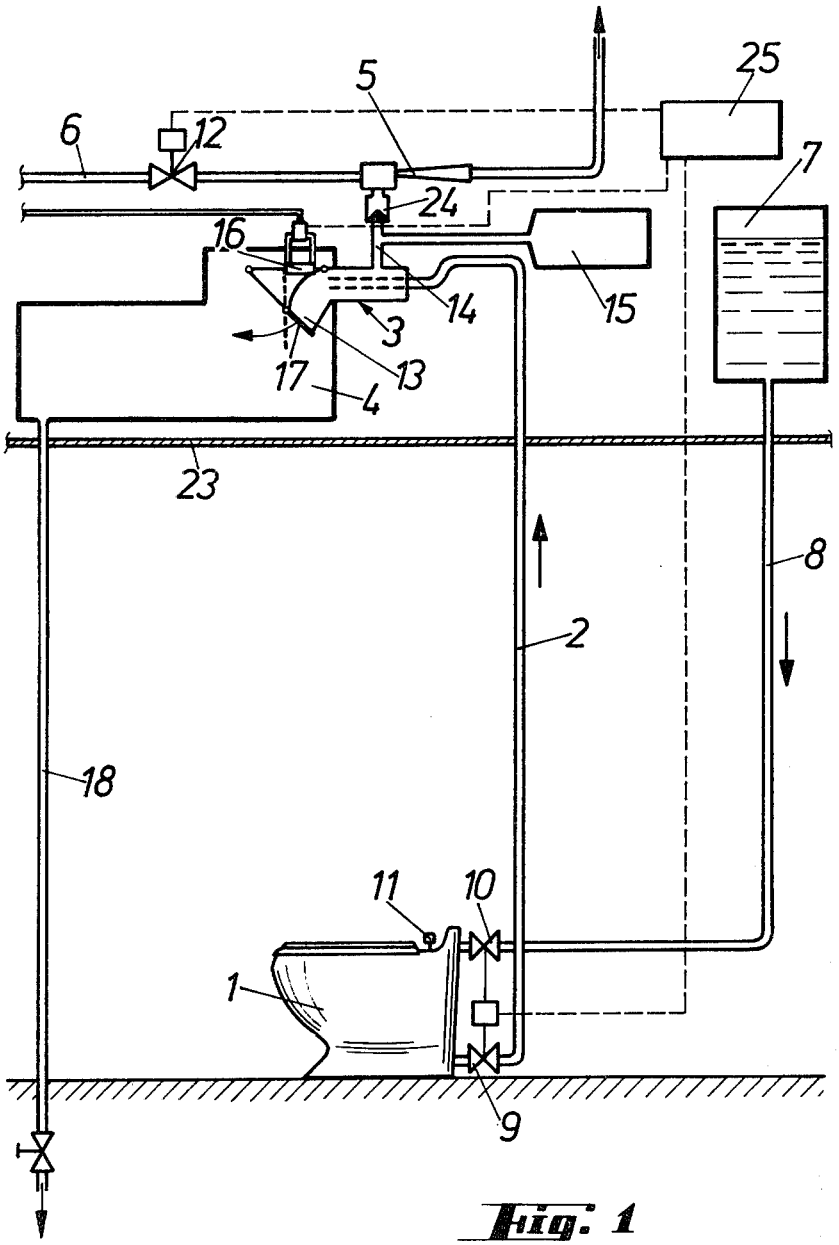

The invention relates to a sewer system, in which partial vacuum is used for transporting sewage through a sewer pipe to a collecting chamber or the like.

A so called vacuum sewer, in which sewage is transported by means of vacuum, is a known arrangement, which has been used in such cases, where low water consumption, small pipe dimensions and the possibility of leading the pipes also upwards have been particularly important for the sewage system. However, the equipment required for generating vacuum has been relatively expensive, so that it has not so far been profitable to build vacuum sewage systems for only a few water-closets or a corresponding sewage producing units.

The object of the invention is to create a vacuum sewage system that is particularly well suitable for a sewage system with only a few, preferably only one water-closet or the like. The object of the invention is also to create a vacuum sewage system that is particularly well suitable as a sewage system of a railway car or a corresponding moving unit.

The invention is characterized in that the system comprises only a few sewage producing units, preferably only one at a time usable unit, that the length of the drain pipe from the sewage producing unit to the collecting chamber or the like is comparatively small and that the operating devices of the system are arranged to generate vacuum in the sewer pipe principally only for the time required for transporting each separate sewage discharge. The expression "only one at a time usable unit" means that the sewage system may comprise several sewage producing units, if it is predictable that they are not used at the same time. Such a use at separate times can be natural, for instance, the closet and the wash basin of a WC-unit are not used at the same time, or the use can be so controlled, that the sewage can be discharged into the sewer pipes from only one unit at a time.

The construction of a sewage system according to the invention will come out very simple, in particular for the reason that vacuum is generated in the sewer pipe only for the time required for transporting each separate sewage discharge. Consequently, there is no need to maintain vacuum continuously in the sewer pipe as is the case in conventional vacuum sewers, and no devices are needed to watch the continuous function of the vacuum system. In a system according to the invention, the generation of vacuum is dependent on each discharge of sewage, so that every discharge impulse causes the required vacuum to be generated, opens the discharge valve of the unit to be emptied and takes care of the other functions directly connected to the discharge operation. In practice this means that the whole sewage system has to have a relatively small volume. To avoid that the time needed for generating vacuum would not be unreasonably long, the volume to be put under vacuum should normally be smaller than 100 liters, preferably smaller than 50 liters. However, for use in, for instance, a railway car, such a small volume as 35 liters is quite sufficient for the needs of one WC-unit. In a system according to the invention the volume of the sewer pipe itself should not be very big. A bigger volume than 30 liters cannot usually be recommended, preferably the volume of the sewer pipe should not exceed 20 liters.

Practice has shown, that in a system according to the invention is is most advantageous to stop generating the vacuum needed for transporting sewage before the actual transport of the sewage, and to dimension the sewage system so that the vacuum generated already before the transport is sufficient per se for accomplishing the desired transport function. Because the vacuum generating device is not functioning during transport of sewage, the danger, that impurities and humidity would be sucked into this device, is very small. This contributes to the functional reliability of the system.

In particular, when using a system according to the invention as the sewage system of a railway car or the like, it is of advantage to generate vacuum by means of pressurized gas, preferably by means of compressed air, in an ejector or a corresponding device. In a railway car, there is already for other reasons a compressed air network, and from this network sufficient amounts of compressed air are obtainable for a quick generation of vacuum. If compressed air is not available, a pressure chamber and a separate air pump may be used, whereby the pump automatically keeps the pressure in the pressure chamber at a sufficiently high level.

In a system according to the invention, it is recommendable to use the collecting chamber, in a way known per se, as an intermediate container, in which the sewage is collected before it, after the actual transport by means of vacuum, is allowed to flow into a collecting tank under atmospheric pressure. Any suitable, relatively small tank may function as such an intermediate container, provided that it is tightly connectable to the vacuum system and is provided with a device for emptying it into the collecting tank. Emptying of the intermediate container can take part by turning it upside-down so that the sewage flows away from it into the collecting tank, or by providing it with a bottom opening which is opened for emptying.

In order to get the vacuum sewer system to work well in practice, it is necessary that downstream of the end of the sewer pipe there is a space of sufficient volume, which is under vacuum and in which the pressure blow of the atmospheric air required for the transport of the sewage is equalized. In particular this concerns the case, when vacuum is not generated during the transport of sewage. The volume of this auxiliary space should preferably be at least as big as as the volume of the sewer pipe. The auxiliary space can be obtained by providing, in direct connection with the collecting chamber, a sufficient air space, but in addition to this, it may be of advantage to add to the system a separate air tank in order to obtain an auxiliary space big enough. Such an air tank can be connected to the suction duct of the vacuum generating device by means of a separate branch conduit.

When a sewage system according to the invention is used in a railway car or in a corresponding unit, it is of advantage to locate the emptying device of the vacuum sewer with its collecting chamber, its collecting tank and other auxiliary means required for the function of the system to a space above the ceiling of the car. This space is usually very narrow in a vertical direction, so that the devices must be designed to be as low as possible. Known emptying devices for vacuum systems are vertically high, but in a system according to the invention, an emptying device of a very low construction has proved to be very well usable. An advantageous design is obtained by dimensioning the part of the collecting chamber below the end of the sewer pipe so that its volume corresponds approximately to the normal volume of a single discharge of sewage or is just a little bigger. For emptying a vacuum closet, a volume of 1 . . . 2 liters is sufficient. However, it is feasible that a sewage discharge in some special cases is considerably greater than normally, for instance, if somebody has filled the closet bowl with water, and there has to be a reserve space for such cases. The maximum volume of a sewage discharge is determined by the volume of the sewage producing unit. In other words, it is not possible to discharge more fluid into the sewer pipe than what is containable in a closet bowl, a wash basin or a corresponding unit. If, however, the maximum volume would be discharged, for such a special case, there has to be a container space in connection with the collecting chamber and at its upper edge, which space is able to receive the amount of fluid in question. This additional space can easily be made very low and it can be located, for instance, around the outlet end of the sewer pipe.

In a conventional emptying device of a vacuum sewer, there is at the end of the sewer pipe a non-return flap, the purpose of which is to prevent the atmospheric pressure prevailing in the collecting chamber during its emptying from penetrating into the sewer pipe system. In a system according to the invention, such a non-return flap is not required, and the sewer pipe may be in direct connection with the collecting chamber. This is of advantage, because then the sewage is able to flow quite freely into the collecting chamber. In conventional vacuum sewer systems, the emptying of the collecting chamber takes place through a bottom valve with a counterweight balanced flap. However, the functional reliability of a device of this kind has not proved to be quite satisfactory in all applications, and hence, a mechanically operable emptying device is preferred in a system according to the invention, which device shuts and opens the emptying opening of the collecting chamber or turns the whole collecting chamber upside-down for emptying. This kind of emptying is carried out after each discharge of sewage into the collecting chamber. Because the emptying is mechanically operated, its functional reliability is high and it is performed with such a great force that dirt possibly stuck to the sealing surfaces of the emptying opening does not cause leakage or other functional disturbances.

Figure 2:
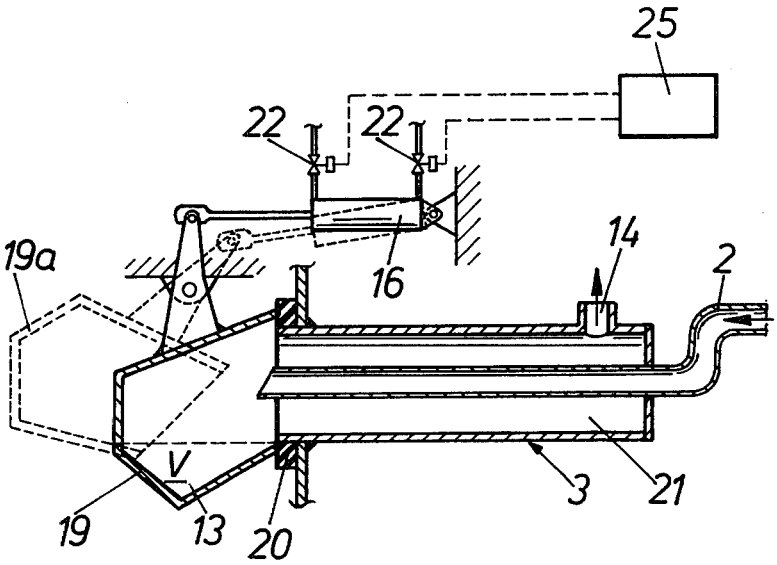

In the following, the invention will be more fully described with reference to the attached drawing, wherein FIG. 1 shows an elementary diagram of a sewage system according to the invention, and FIG. 2 shows a longitudinal section of one embodiment of the emptying device of a sewage system according to the invention.

In the drawing, the numeral 1 indicates a water-closet connected to a vacuum system, 2 a vacuum sewer connected to the water-closet and 3 an emptying device for the sewer, through which device sewage is emptied into a collecting tank 4. The system also includes a vacuum generating ejector 5, which works with compressed air received from a compressed air network 6. Flush water to the water-closet 1 is received from a water tank 7 through a pipe 8. Emptying of the water-closet and feeding of flush water to the water-closet bowl is automatically controlled by means of valves 9 and 10. A flushing impulse is effected by operating a flush knob 11. An automatic control device 25 controlling the function of the system is only schematically shown in the drawing, because such devices are generally used in vacuum sewer systems and their construction and design does not per se cause any difficulties, when the desired functions have been determined.

When a flushing impulse is given by means of flush knob 11, control device 25 of the system opens valve 12 of compressed air pipe 6 connected to ejector 5. Ejector 5 rapidly generates vacuum in the sewer pipe and in its emptying device 3. When a sufficient vacuum has been generated, compressed air valve 12 is closed, the suction effect of ejector 5 ceases, and discharge valve 9 of water-closet 1 is opened. If the vacuum system in question has a total volume of less than 50 liters, the equipment can easily be so dimensioned that the generating of vacuum takes less than 5 seconds. Preferably, a vacuum of about half an atmosphere is used. Upon flushing, discharge valve 9 of the water-closet is closed, and flush water flowing through flush valve 10, which has been opened already earlier, fills the lower part of the water-closet bowl with a small amount of water. The total amount of flush water does not usually have to be greater than 1,5 liters.

Since there is vacuum in sewer pipe 2 when discharge valve 9 opens, the pressure of the atmospheric air presses the sewage present in the water-closet through pipe 2 to collecting chamber portion 13 of emptying device 3. In order to ensure that the sewage transport is successfully carried out, it is essential that downstream of the outlet end of sewer pipe 2 there is a sufficiently big air space. If collecting chamber 13 and the pipes connected thereto do not together form a space big enough, there can be connected to suction duct 14 leading to ejector 5 of emptying device 3, a separate air tank upstream of non-return valve 24 in front of the ejector. As a dimensioning example it could be stated that sewer pipe 2 may have a volume of 5 to 10 liters, emptying device 3 together with its collecting chamber a volume of about 7 liters and auxiliary tank 15 a volume of about 18 liters.

In connection with an emptying of water-closet 1 the vacuum in sewer pipe 2 and in its emptying device 3 is almost completely equalized. Discharge valve 9 can be constructed to be closed automatically, when there is not anymore essential vacuum in sewer pipe 2. Immediately after flushing, a small power cylinder 16, preferably working with compressed air, opens bottom flap 17 of collecting chamber 13 and the sewage present in the collecting chamber flows into collecting tank 4. After this, power cylinder 16 closes bottom flap 17. Collecting tank 4 is regularly emptied through outlet pipe 18. Collecting tank 4 may be provided with usual alarm and safety devices to prevent overfilling.

FIG. 2 shows the end portion of sewer pipe 2, emptying device 3, collecting chamber 13, its emptying cylinder 16 and suction duct 14 connected to the emptying device. The emptying mechanism shown in FIG. 2 differs somewhat from the embodiment shown in FIG. 1. In FIG. 2, emptying chamber 13 has no bottom flap, but the chamber is formed as a turnable bucket 19. As shown with broken lines **19*a*, the bucket can be turned around by means of power cylinder 16 so that it is emptied. When bucket 19 is in sewage receiving position, the edge of its mouth is pressed against a rubber sealing 20. The volume V of the lower portion of collecting chamber 13 corresponds to the volume of a single sewage discharge. If, however, in some special cases, the volume of a sewage discharge is exceptionally great, there is a reserve space 21 with a volume corresponding to the total volume of the water-closet bowl or to the total volume of an equivalent sewage producing unit connected to sewer pipe 2**.

Emptying of collecting chamber 13 takes place automatically after each sewage discharge. The automatic control device 25 of the system takes care of this by controlling valves 22 of the inlet and outlet conduits of power cylinder 16. This has the advantage that the collecting chamber can be small and that it does not need, for instance, a surface level sensor or any other over-filling preventing device.

If a device according to the invention is installed in a railway car or the like, it is favourable to insert all the tanks and the functional devices connected thereto above ceiling 23 of the car (FIG. 1). Due to this, the emptying device shown in FIG. 2 is designed to be as low as possible. Power cylinder 16 is shown above emptying device 3 to obtain a clearer representation, but actually, it may be inserted beneath emptying device 3 as well. Also ejector 5 shown in FIG. 1 may actually be located much lower, even below emptying device 3.

The invention is not limited to the embodiments shown, but several variations thereof are feasible within the scope of the attached claims.

I claim:

1. A sewer system including means for generating a partial vacuum for transporting sewage through a sewer pipe to a collecting chamber for an installation comprising a small number of sewage producing units, preferably only one of said sewage producing units being usable at a time, said sewer pipe between each said sewage producing unit and said collecting chamber having a small total volume, control means for starting and stopping said partial vacuum generating means, and means for activating said control means for generating a vacuum in said sewer pipe principally only for the time required for transporting each separate sewage discharge from a selected one of said small number of sewage producing units to said collecting chamber, and said sewer pipe being otherwise under a higher pressure.

2. A system according to claim 1, including sewage discharge means, said control means being connected to said activating means and to said sewage discharging means, and means for operating and stopping said vacuum generating means before activating said sewage discharging means.

3. A system according to claim 1 or 2, in which said vacuum generating means includes a source of pressurized gas, and a gas pressure driven vacuum generating device.

4. A system according to claim 1, in which said vacuum generating means includes a source of compressed air, and a gas pressure driven vacuum generating ejector.

5. A system according to claim 1, including a collecting tank, said collecting chamber being arranged as a flow connection means between said sewer pipe and said collecting tank under atmospheric pressure, said collecting chamber being upstream of and in gravity flow connection with the interior of said collecting tank.

6. A system according to claim 5, in which downstream of the outlet end of said sewer pipe there is an auxiliary space in connection with said vacuum generating means, and the total volume of said auxiliary space being at least as large as the volume of said sewer pipe.

7. A system according to claim 6, in which said auxiliary space is at least partly formed by a separate air tank connected to a suction duct of said vacuum generating device.

8. A system according to claim 1, in which the total volume to be put under vacuum is smaller than 100 liters.

9. A system according to claim 1, in which the total volume to be put under vacuum is smaller than 50 liters.

10. A system according to claim 1, being arranged to function as a sewer system of a railway car or of another moving unit having a source of pressurized gas suitable for rapid vacuum generation.

11. A system according to claim 1, in which a portion of said collecting chamber is below the outlet end of said sewer pipe and has a volume (V) corresponding approximately to the normal volume of a single discharge of sewage or is only slightly bigger, said system having, in connection with said collecting chamber at its upper edge, a container space big enough to receive as much fluid as is containable at one time in any of said sewage producing units.

12. A system according to claim 1, in which said sewer pipe is in direct open connection with said collecting chamber or the like.

13. A system according to claim 1, in which the volume of said sewer pipe is at the most 30 liters.

14. A system according to claim 1, in which the volume of said sewer pipe is at the most 20 liters.

15. A system according to claim 1, in which said collecting chamber is provided with a mechanically working emptying device connected to said control means so as to be operative after every discharge of sewage into said collecting chamber.

* * * * *